US009568007B2

(12) United States Patent
Iurisci et al.

(10) Patent No.: US 9,568,007 B2
(45) Date of Patent: Feb. 14, 2017

(54) MULTISTAGE CENTRIFUGAL TURBOMACHINE

(75) Inventors: Giuseppe Iurisci, Florence (IT); Angelo Grimaldi, Florence (IT)

(73) Assignee: Nuovo Pignone SPA, Florence (IT)

( * ) Notice: Subject to any disclaimer, the term of this patent is extended or adjusted under 35 U.S.C. 154(b) by 461 days.

(21) Appl. No.: 14/233,938

(22) PCT Filed: Jul. 19, 2012

(86) PCT No.: PCT/EP2012/064232
§ 371 (c)(1),
(2), (4) Date: Jan. 21, 2014

(87) PCT Pub. No.: WO2013/011105
PCT Pub. Date: Jan. 24, 2013

(65) Prior Publication Data

US 2014/0133959 A1 May 15, 2014

(30) Foreign Application Priority Data

Jul. 21, 2011 (IT) ..... CO2011A0027

(51) Int. Cl.
*F04D 17/08* (2006.01)
*F04D 29/28* (2006.01)
(Continued)

(52) U.S. Cl.
CPC ..... *F04D 17/08* (2013.01); *F04D 1/06* (2013.01); *F04D 17/122* (2013.01);
(Continued)

(58) Field of Classification Search
CPC .... F04D 17/08; F04D 29/284; F04D 29/2216; F04D 17/122; F04D 29/167; F04D 29/162; F04D 1/06
(Continued)

(56) References Cited

U.S. PATENT DOCUMENTS 1,281,478 A 10/1918 Antisell
2,543,923 A 3/1951 Mixsell
(Continued)

FOREIGN PATENT DOCUMENTS

CN 86101358 A 12/1986
CN 101042144 A 9/2007
(Continued)

OTHER PUBLICATIONS

Italian Search Report from corresponding Italian Application No. CO20110027, dated Mar. 26, 2012.
(Continued)

*Primary Examiner* — Hoang Nguyen
(74) *Attorney, Agent, or Firm* — GE Global Patent Operation

(57) ABSTRACT

A multistage centrifugal turbomachine comprising a rotor assembly comprising a shaft carrying a first and a second impeller, and a stator comprising a passage for a fluid flowing from an outlet side of the first impeller to an inlet side of the second impeller, the passage comprising a diffuser downstream the outlet side of the first impeller), a return channel upstream the inlet side of the second impeller, a bend connecting the diffuser and the return channel, and a plurality of stator blades being provided in the return channel, wherein a portion of the return channel is delimited by the first impeller, the plurality of stator blades extending at least partially in the portion of the return channel.

10 Claims, 3 Drawing Sheets

(51) Int. Cl.

| | |
|---|---|
| ***F04D 1/06*** | (2006.01) |
| ***F04D 17/12*** | (2006.01) |
| ***F04D 29/16*** | (2006.01) |
| ***F04D 29/22*** | (2006.01) |

(52) U.S. Cl.
CPC ..... *F04D 29/162* (2013.01); *F04D 29/167* (2013.01); *F04D 29/2216* (2013.01); *F04D 29/284* (2013.01)

(58) Field of Classification Search
USPC ..... 415/173.5, 174.5, 199.2, 199.5
See application file for complete search history.

(56) References Cited

U.S. PATENT DOCUMENTS

| | | | | |
|---|---|---|---|---|
| 3,265,001 | A * | 8/1966 | Deters | F04D 13/10 415/141 |
| 4,278,399 | A * | 7/1981 | Erickson | F04D 13/10 415/199.1 |
| 4,697,987 | A | 10/1987 | Katayama et al. | |
| 5,344,285 | A | 9/1994 | O'Sullivan | |
| 5,362,203 | A * | 11/1994 | Brasz | F04D 29/4213 415/187 |
| 5,752,803 | A * | 5/1998 | Wetzel | F04D 1/06 415/182.1 |
| 5,755,554 | A * | 5/1998 | Ryall | F04D 3/00 415/199.4 |
| 6,162,015 | A | 12/2000 | Nagai | |
| 8,075,260 | B2 | 12/2011 | Aki et al. | |
| 2011/0014059 | A1 | 1/2011 | Giovannetti et al. | |

FOREIGN PATENT DOCUMENTS

| | | | |
|---|---|---|---|
| CN | 101956187 | A | 1/2011 |
| JP | 07167086 | A | 7/1995 |
| JP | 10205485 | A | 8/1998 |
| JP | 2003322098 | A | 11/2003 |
| RU | 2140578 | C1 | 10/1999 |
| SU | 754115 | A1 | 8/1980 |

OTHER PUBLICATIONS

PCT Search Report and Written Opinion from corresponding PCT International Application No. PCT/EP2012/064232, dated Jan. 16, 2013.

Unofficial English translation of Notice of Allowance issued in connection with corresponding RU Application No. 2013158435 on Jun. 1, 2016.

Unofficial English Translation of Chinese Office Action issued in connection with corresponding CN Application No. 201280036186.5 on Jul. 30, 2015.

Unofficial English Translation of Japanese Office Action issued in connection with corresponding JP Application No. 2014-520670 on May 10, 2016.

* cited by examiner

MULTISTAGE CENTRIFUGAL TURBOMACHINE

BACKGROUND OF THE INVENTION

The present invention relates to multistage centrifugal turbomachines and to centrifugal impellers for multistage centrifugal turbomachines, particularly, but not exclusively, for oil and gas applications.

A centrifugal turbomachine is a rotary machine where mechanical energy is transferred between a working fluid and a rotary assembly including at least one centrifugal impeller. In oil and gas application, where the fluid is typically a gaseous fluid, centrifugal turbomachines include compressors and expanders. A compressor is a turbomachine which increases the pressure of a gaseous fluid through the use of mechanical energy. An expander is a turbomachine which uses the pressure of a working gaseous fluid to generate mechanical work on a shaft of the rotary assembly by means of the expansion of the fluid in the impeller(s).

In uncompressible fluid, e.g., water, centrifugal turbomachines include pumps and turbine, which transfer energy between the fluid and the impeller in a way analogous to compressors and expanders, respectively.

In general, in all cases, the working fluid exchanges energy with the centrifugal machine by flowing in the centrifugal impeller along a radial outward direction, oriented from an axis of rotation of the impeller to a peripheral circumferential edge of the impeller.

In particular, the centrifugal impeller of a compressor turbomachine transfers the mechanical energy supplied by a motor that drives the turbomachine to the working gaseous fluid being compressed by accelerating the fluid in the centrifugal impeller. The kinetic energy imparted by the impeller to the working fluid is transformed into pressure energy when the outward movement of the fluid is confined by a diffuser and the machine casing.

Centrifugal turbomachines are frequently referred to as single stage turbomachines when they are fitted with a single impeller, or as multistage centrifugal turbomachines when they are fitted with a plurality of impellers in series.

A prior art embodiment of a multistage centrifugal compressor 100 is illustrated in FIG. 1, in an overall section view.

The multistage centrifugal compressor 100 operates a process gas between an input pressure and an output pressure which is higher than the input pressure. The process gas may, for example, be any one of carbon dioxide, hydrogen sulfide, butane, methane, ethane, propane, liquefied natural gas, or a combination thereof.

Compressor 100 comprises a stator 102 within which is mounted a rotary assembly 103 including a shaft 104, which carries a plurality of identical impellers (three impellers 110, 111, 112 in the embodiment in FIG. 1) in series. The shaft 104 extends along an axis of rotation Y of compressor 100, having an axial span A, measured from the first impeller 110 to the last impeller 112.

Each impeller 110, 111, 112 has a typical closed design configuration including an impeller hub 113, which closely encircles the shaft 104, and a plurality of rotary blades 108 extending between a rear impeller disc 123 and a front shroud 119. The impeller disc 123 comprises a front side 124, which supports the plurality of rotary blades 108, and a rear side 125, which is opposite to front side 124. Each impeller 110, 111, 112 respectively comprises a low-pressure inlet side 110*a*, 111*a*, 112*a* defined by an impeller eye 115 on the front shroud 109 and a high-pressure outlet side 110*b*, 111*b*, 112*b* defined by a peripheral circumferential edge of the impeller 110, 111, 112.

The multistage compressor 100 is subdivided into a plurality of stages 107*a,b,c* (three stages in the embodiment in FIG. 1), each stage 107*a,b,c* including a respective impeller of the plurality of impellers 110, 111, 112. Between the first and second stage 107*a,b* the stator 102 includes a passage 105 for a process gas flowing from the outlet side 110*b* of the first impeller 110 to the inlet side 111*a* of the second impeller 111. The passage 105 comprises a diffuser 126 downstream the outlet side 110*b*, a return channel 128 upstream the inlet side 111*a* and a U-shaped bend 127 connecting the diffuser 126 and the return channel 128. A plurality of stator blades 115 are provided in the return channel 128 for guiding the process fluid toward the inlet side 111*a* of the second impeller 111. The process gas flowing in the diffuser 126 is directed along a first outward radial direction orthogonal to the axis of rotation Y while the gas flowing in the return channel 128 is directed along a second inward radial direction oriented toward the axis of rotation Y, the bend 127 providing a 180° degree deflection of the gas flow.

Analogously, a passage identical to passage 105 is provided in the stator 102 for the same process gas flowing from the outlet side 111*b* of the second impeller 111 to the inlet side 112*a* of the third impeller 112.

The passage 105 is provided in a diaphragm 118 extending in the stator 102 from one to the following impeller of the series of impellers 110, 111, 112. The diaphragm 118 comprises a first portion 138 extending axially, i.e., along an axial direction parallel to the axis of rotation Y, from the diffuser 126 and the rear side 125 of the impeller disc 123 to the return channel 128, and extending radially, i.e., along a radial direction orthogonal to the axis of rotation Y, between the shaft 102 and the bend 127. A seal 130 is provided in the gap 131 between the first portion 138 of the diaphragm 118 for preventing the process gas from leaking through the gap 131. The diaphragm 118 comprises a second portion 139 extending axially from the return channel 128 to the following stage of the plurality of stages 107*a,b,c*. An impeller eye seal 140 of the labyrinth type is provided between an impeller eye of the front shroud 119 of each centrifugal impeller 110, 111, 112 and the respective portion 139 of the diaphragm 118, in order to prevent the fluid from leaking in the space between each impeller 110, 111, 112 and the respective portion 139, from the outlet high-pressure side of the impeller to the inlet low-pressure side thereof.

It would be desirable to reduce as much as possible the axial span A, in order to reduce the overall sizes, weight and, as a consequence, cost of the turbomachine. In addition an axial span reduction would result in an improved rotordynamic behaviour, improving the stability of the rotary assembly which depends on the ratio between axial and radial sizes.

BRIEF SUMMARY OF THE INVENTION

An object of the present invention is to optimize the design of a multistage centrifugal turbomachine to reduce the axial dimensions of the turbomachine.

According to a first embodiment, the present invention accomplish the object by providing a multistage centrifugal turbomachine comprising a rotor assembly comprising a shaft carrying at least a first impeller and a second impeller; a stator comprising a passage for a fluid flowing from an outlet side of the first impeller to an inlet side of the second impeller; the passage comprising a diffuser downstream the outlet side of the first impeller, a return channel upstream the inlet side of the second impeller and a bend connecting the diffuser and the return channel, a plurality of stator blades being provided in the return channel for guiding the fluid toward the inlet side of the second impeller; wherein at least a portion of the return channel is delimited by the first impeller, the plurality of stator blades extending at least partially in the portion of the return channel.

The design of the impellers and of the diaphragms between impellers allows to build a turbomachine where a portion of the return channel between a first and a second impeller in series is created by the first impeller disc profile. Such a portion of the return channel comprises a portion of the stator blades, thus giving a significant contribute in guiding the fluid toward the impeller immediately downstream the return channel. This allows to reduce the diaphragm axial span to the minimum by eliminating, in a conventional stage of a multistage turbomachine, the portion of the diaphragm extending between the impeller disc and the return channel downstream the impeller. This allows to reduce the overall axial span of the turbomachine.

In a second embodiment, the present invention provides a centrifugal impeller for a centrifugal turbomachine comprising a rotor assembly comprising a shaft carrying at least two impellers and a stator comprising a passage for a fluid flowing from an outlet side of a first impeller to a second impeller; the passage comprising a diffuser downstream the first impeller and a return channel upstream the second impeller for guiding the second impeller; the impeller comprising a plurality of rotary blades and an impeller disc having a front side which supports the plurality of rotary blades and a rear side which is opposite to the front side and which is shaped in order to delimit at least a portion of the return channel of the multistage centrifugal turbomachine.

The same advantages described above with reference to the first embodiment of the present invention are accomplished by the second embodiment.

Further features of the first and second embodiment are obtained with the multistage centrifugal turbomachine and with the impeller described in the dependent claims.

BRIEF DESCRIPTION OF THE DRAWINGS

Other object feature and advantages of the present invention will become evident from the following description of the embodiments of the invention taken in conjunction with the following drawings, wherein.

DETAILED DESCRIPTION OF THE EXEMPLARY EMBODIMENTS OF THE INVENTION

Figure 2:
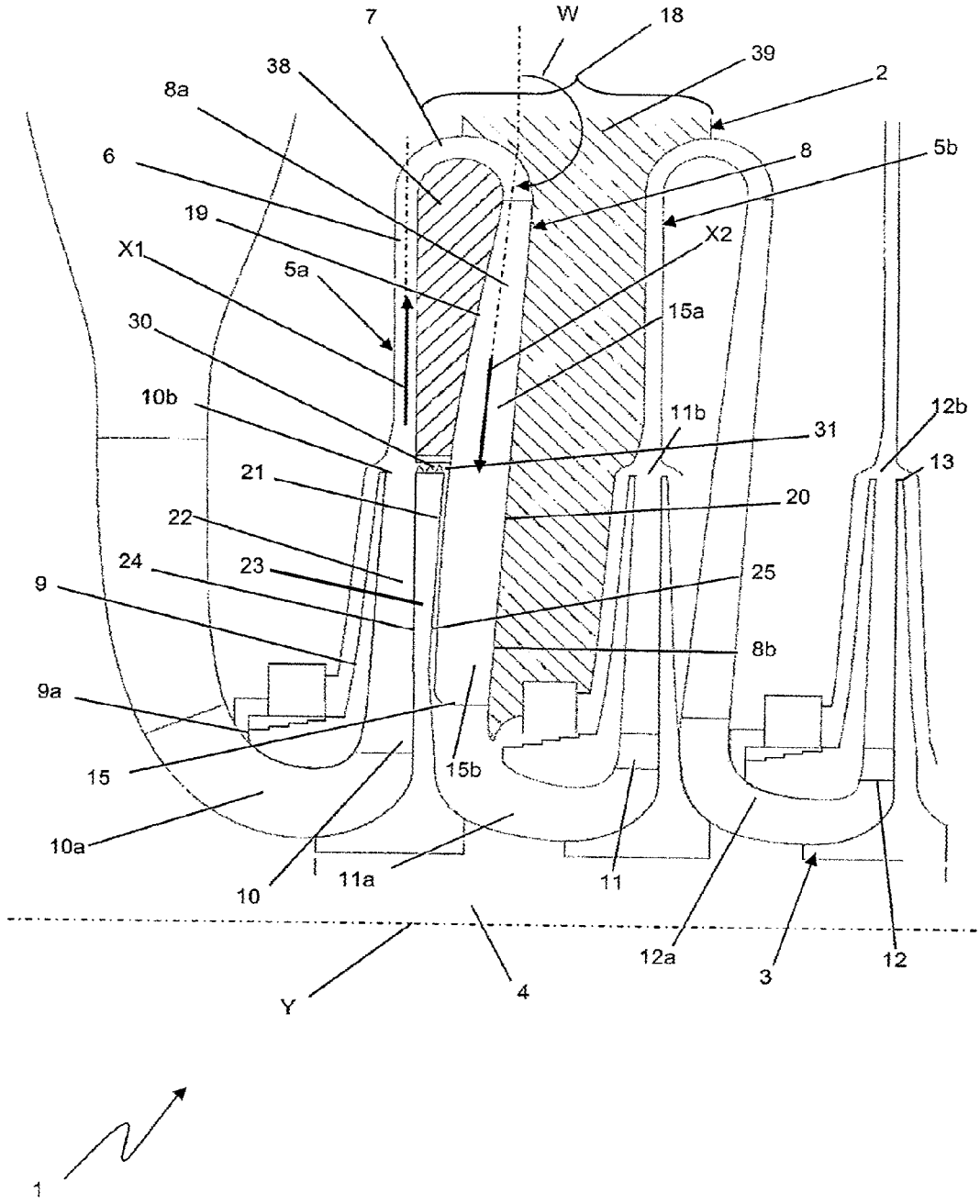
FIG. 2 is a longitudinal sectional view of a centrifugal turbomachine according to an embodiment of the present invention.

A first and a second embodiment of the present invention are both shown in FIG. 2.

With reference to FIG. 2, a multistage centrifugal turbomachine 1 is constituted by a multistage centrifugal compressor. The turbomachine 1 comprises a rotary assembly 3 comprising a shaft 4, which carries a plurality of impellers (a first impeller 10, a second impeller 11 and a third 12 in the embodiment in FIG. 2) in series and a stator 2 within which the rotary assembly 3 is mounted. The shaft 4 extends along an axis of rotation Y of the turbomachine 1, having an axial span B, measured from the first impeller 10 to the last impeller 12.

Figure 1:
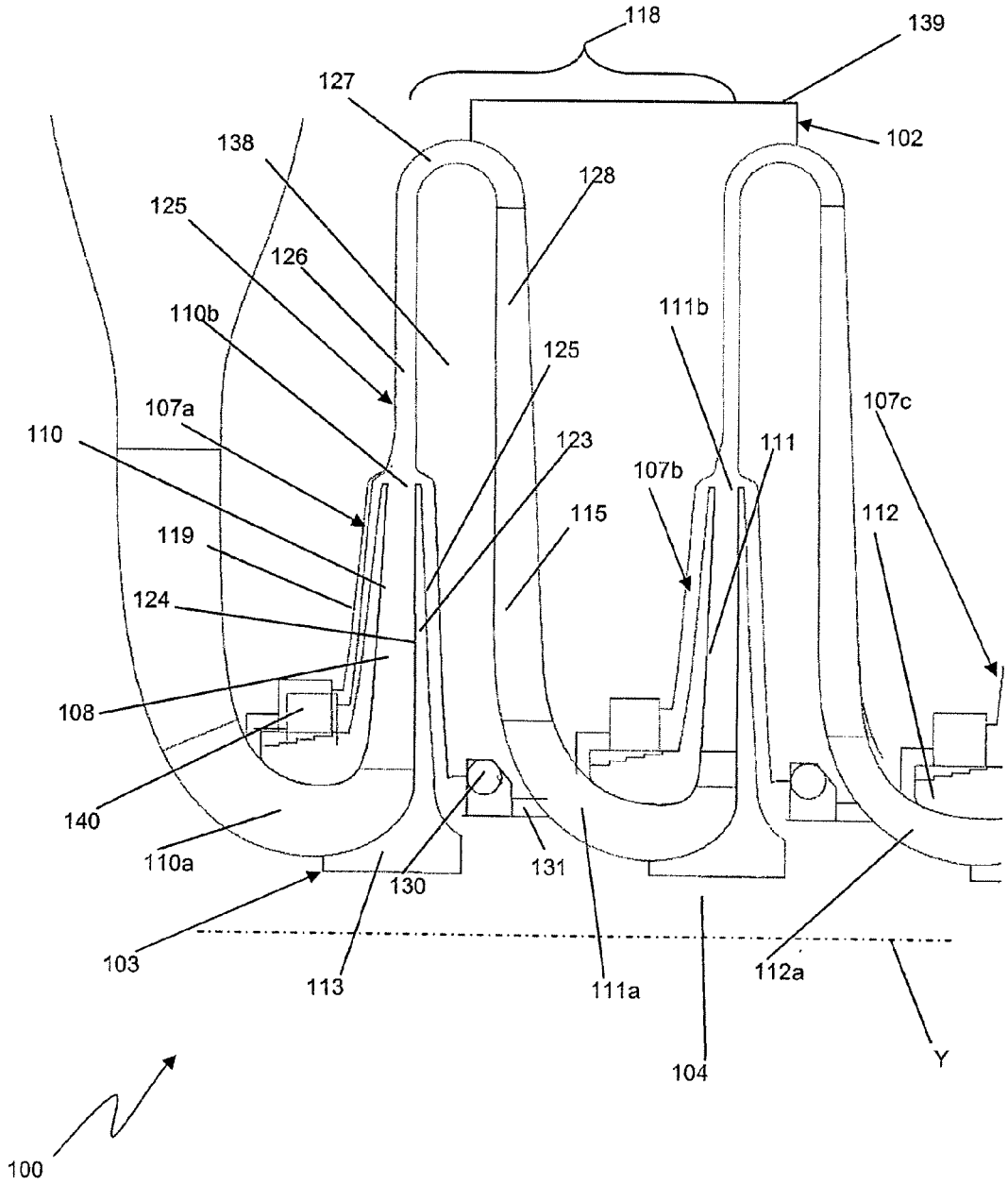
Fig. 1 (PRIOR ART)
FIG. 1 is a longitudinal sectional view of a conventional centrifugal turbomachine.

The casing 2 and the rotor assembly 3 are subdivided into a plurality (three) of stages 1*a*, 1*b*, 1*c* connected in series, which respectively comprises the impellers 10, 11 and 12. For parts which are not described in the following, the compressor 1 must be considered conventional and identical to compressor 100 in FIG. 1, described above.

Each impeller 10, 11, 12 is of the shrouded type and respectively comprises a low-pressure inlet side 10*a*, 11*a*, 12*a* defined by an impeller eye 9*a* on a front shroud 9 and a high-pressure outlet side 10*b*, 11*b*, 12*b* defined by a peripheral circumferential edge 13 of the impeller 10, 11, 12. Each impeller 10, 11, 12 further comprises a plurality of rotary blades 22 and an impeller disc 23 having a front side 24 which supports the plurality of rotary blades 22 and a rear side 25 which is opposite to the front side 24.

The stator 2 comprises a diaphragm 18 extending between the first and the second impellers 10, 11, where a first passage 5*a* for a process gas flowing from the outlet side 10*b* of the first impeller 10 to the inlet side 11*a* of the second impeller 11 is provided. The stator 2 comprises a second passage 5*b*, identical to passage 5*a*, for the same process gas flowing from the outlet side 11*b* of the second impeller 11 to the inlet side 12*a* of the third impeller 12. Being the passages 5*a*, 5*b* identical, the description of passage 5*a* which follows is to be considered valid, mutatis mutandis, also to describe passage 5*b*.

Passage 5*a* comprises a diffuser 6 downstream the outlet side 10*b* of the first impeller 10, a return channel 8 upstream the inlet side 11*a* of the second impeller 11 and a U-shaped bend 7 connecting the diffuser 6 and the return channel 8, a plurality of stator blades 15 being provided in the return channel 8 for guiding the fluid toward the inlet side 11*a* of the second impeller 11.

The return channel 8 comprises a first portion 8*a* downstream the bend 7 and a second portion 8*b* immediately downstream the first portion 8*a*. The first portion 8*a* of the return channel 8 is delimited by a first and a second surface 19, 20 on the diaphragm 18. The first and second surface 19, 20 are distanced from each other along an axial direction parallel to the axis of rotation Y, the first surface 19 being closer to the first impeller 10 than the second surface 20.

The second surface 20 extends beyond the first portion 8*a* of the return channel 8, in order to delimit also the second portion 8*b* thereof.

The second portion 8*b* of the return channel 8 is delimited by the second surface 20 of the diaphragm 18 and by a third surface 21 which is provided on the rear side 25 of the impeller disc 23 of the first impeller 10. The third surface 21 is adjacent to the first surface 19 of the diaphragm 18 and axially distanced from the second surface 20. The third surface 21 is shaped in order to delimit the second portion 8*b* of the return channel 8 so as to contribute in guiding the fluid toward the inlet side 11*a* of the second impeller 11.

Each blade 15 of the plurality of stator blades 15 comprises a first portion 15*a* extending in the first portion 8*a* of the return channel 8 between the first and the second surface 19, 20 of the diaphragm 18. Each stator blade 15 further comprises a second portion 15*b* extending in the second portion 8*b* of the return channel 8 between the second surface 20 of the diaphragm 18 and the third surface 21 of the rear side 25 of the impeller disc 23.

A seal 30 of the labyrinth type is provided in a gap 31 between the first and third surfaces 19, 21 for preventing the fluid from flowing from the outlet side 10*b*, 11*b* of the first and second impellers 10, 11 directly to the respective return channel 8, without first flowing through the respective diffuser 6 and bend 7. Seal 30 has the same function of seal 130 described with reference to the conventional solution in FIG. 1, i.e., to prevent leakages from the outlet side 10*b*, 11*b* of each impeller 10, 11 toward the respective next impeller 11, 12.

The seal 30 is provided between the circumferential edge 13 of the impeller disc 23 and a portion 38 of the diaphragm 18 which extends axially between the diffuser 6 and the return channel 8 and radially between the impeller disc 23 and the bend 7.

The seal 30 comprises a plurality of seal teeth which can be either rotoric, i.e. manufactured together with the blade disc as shown in FIG. 2, or statoric, i.e. mounted on the portion 38 of the diaphragm 18.

In the design of the multistage turbomachine 1 above described, the second portion 8*b* of the return channel 8 is delimited by a surface of the impeller 10 while the plurality of stator blades 15 partially extend in the portion 8*b*.

The fluid flowing in the diffuser 6 is directed along a first flow radial direction X1 orthogonal to the axis of rotation Y while the fluid flowing in the return channel 8 is directed along a second flow direction X2 oriented toward the axis of rotation Y. The angle W between the first and second flow direction X1, X2 is greater than 180°. The value of the angle W is typically comprised in the interval 185°-210°.

Embodiments of the present invention can be used also in centrifugal expanders applications.

More in general, embodiments of the present invention can be used also in centrifugal turbomachines for compressible and uncompressible fluids, the latter turbomachines comprising pumps and water turbines.

Figure 3:
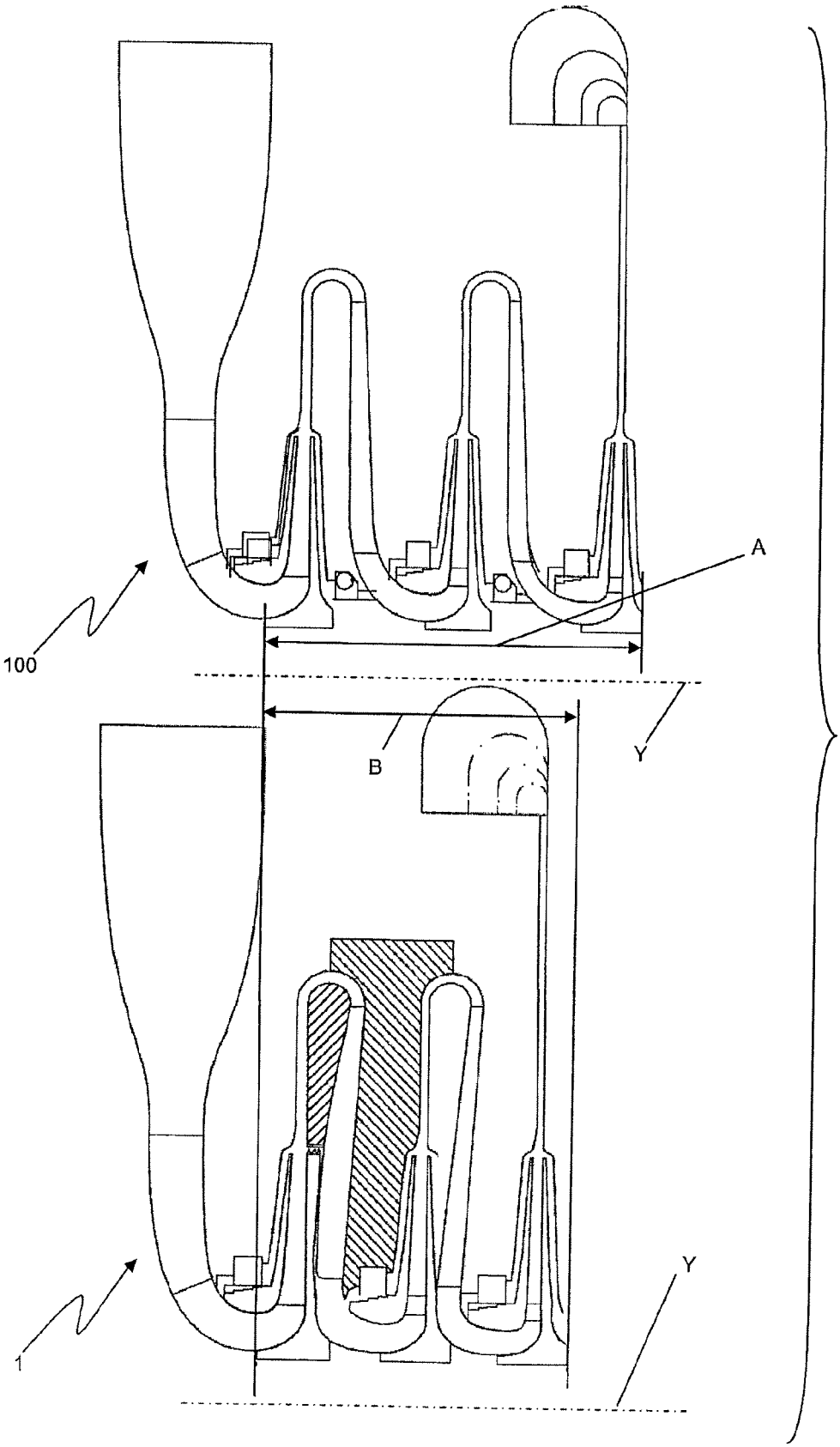
FIG. 3 is a longitudinal sectional view showing a comparison between a conventional centrifugal turbomachine and a centrifugal turbomachine according to an embodiment of the present invention.

The design of the impellers and of the diaphragms between impellers allows to reduce the diaphragm axial size to the minimum by eliminating, with respect to a conventional multistage turbomachine (FIG. 1), the portion of the diaphragm extending between the impeller disc and the return channel downstream the impeller, in other words by reducing as much as possible the portion 38 of the diaphragm 18 on which the labyrinth seal 30 is mounted. This is made possible by using the rear side of each impeller disc to delimit a portion of the return channel. This allows to reduce the overall axial span of the turbomachine and in particular axial span A and B (FIG. 3). Therefore embodiments of the present invention allows to accomplish the object and advantages cited above.

In addition embodiments of the present invention allows to reach further advantages. In particular, experimental tests show thermo and fluid dynamics positive effects on the fluid which flows in the second portion 8*b* of the return channel in contact with the rotating surface 21 of each impeller. The rotation of the impeller effectively contributes to energize the fluid, preventing or delaying fluid separation in the return channel. For the above reason the present application allows to better guide the fluid towards the inlet side of the stages of the turbomachine following the first stage, thus improving the overall efficiency.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements with insubstantial differences from the literal languages of the claims.

The invention claimed is:

1. A multistage centrifugal turbomachine comprising:

a rotor assembly comprising a shaft carrying at least a first impeller and a second impeller; and a stator comprising:

a passage for a fluid flowing from an outlet side of the first impeller to an inlet side of the second impeller, the passage comprising:

a diffuser downstream the outlet side of the first impeller;

a return channel upstream the inlet side of the second impeller;

a bend connecting the diffuser and the return channel; and a plurality of stator blades in the return channel for guiding the fluid toward the inlet side of the second impeller, wherein at least a portion of the return channel wall is rotating and is delimited by the first impeller, and the plurality of stator blades extend at least partially in the portion of the return channel.

2. The multistage centrifugal turbomachine according to claim 1, wherein:

the stator further comprises a diaphragm extending between the first impeller and the second impeller, and the return channel comprises a first portion downstream the bend, and a second portion immediately downstream the first portion, the first portion of the return channel being delimited by a first surface and a second surface on the diaphragm, the first surface and the second surface being distanced from each other along an axial direction parallel to an axis of rotation of the shaft, the second portion of the return channel being delimited by the second surface of the diaphragm and by a third surface on the first impeller, the third surface being adjacent to the first surface and axially distanced from the second surface.

3. The multistage centrifugal turbomachine according to claim 2, wherein each blade of the plurality of stator blades comprises:

a first portion extending in the first portion of the return channel between the first surface and the second surface of the diaphragm; and a second portion extending in the second portion of the return channel between the second surface of the diaphragm and the third surface of the first impeller.

4. The multistage centrifugal turbomachine according to claim 2, wherein each impeller comprises:

a plurality of rotary blades; and an impeller disc comprising:

a front side supporting the plurality of rotary blades; and a rear side, opposite to the front side, comprising the third surface.

5. The multistage centrifugal turbomachine according to claim 4, wherein a seal is provided in a gap between the first surface and the area delimited by the transition from the front side and the third surface for preventing the fluid from flowing from the outlet side of each impeller directly to the respective return channel.

6. The multistage centrifugal turbomachine according to claim 5, wherein the diaphragm comprises a portion extending axially between the diffuser and the return channel and radially between the impeller disc and the bend of the passage, and the seal is provided between the portion of the diaphragm and a circumferential edge of the impeller disc.

7. The multistage centrifugal turbomachine according to claim 6, wherein the seal is of the labyrinth type.

8. The multistage centrifugal turbomachine according to claim 1, wherein the fluid flowing in the diffuser is directed along a first flow radial direction orthogonal to an axis of rotation of the shaft, and the fluid flowing in the return channel is directed along a second flow direction oriented toward the axis of rotation, wherein the angle between the first flow direction and the second flow direction is greater than 180°.

9. An impeller for a multistage centrifugal turbomachine, wherein the multistage centrifugal turbomachine comprises a rotor assembly comprising a shaft carrying at least two impellers, and a stator comprising a passage for a fluid flowing from an outlet side of a first impeller to a second impeller, wherein the passage comprises a diffuser downstream the first impeller, and a return channel upstream the second impeller for guiding the second impeller, the impeller comprising:

a plurality of rotary blades; and an impeller disc comprising:

a front side supporting the plurality of rotary blades; and a rear side, opposite to the front side, shaped to delimit at least a rotating portion of the return channel of the multistage centrifugal turbomachine.

10. The impeller according to claim 9, wherein the impeller disc further comprises a circumferential edge and a seal between the circumferential edge and the stator of the multistage centrifugal turbomachine.

* * * * *